US011505768B2

(12) United States Patent
Caragay et al.

(10) Patent No.: US 11,505,768 B2
(45) Date of Patent: Nov. 22, 2022

(54) PROCESS FOR PREPARING A SPRAY-DRIED LAUNDRY DETERGENT PARTICLE

(71) Applicant: The Procter & Gamble Company, Cincinnati, OH (US)

(72) Inventors: Jose Rodel Mabilangan Caragay, Newcastle upon Tyne (GB); Hossam Hassan Tantawy, Northumberland (GB)

(73) Assignee: The Procter & Gamble Company, Cincinnati, OH (US)

( * ) Notice: Subject to any disclaimer, the term of this patent is extended or adjusted under 35 U.S.C. 154(b) by 52 days.

(21) Appl. No.: 17/034,378

(22) Filed: Sep. 28, 2020

(65) Prior Publication Data

US 2021/0009929 A1 Jan. 14, 2021

Related U.S. Application Data

(63) Continuation of application No. PCT/US2019/024197, filed on Mar. 27, 2019.

(30) Foreign Application Priority Data

Mar. 28, 2018 (EP) ..... 18164686
Mar. 27, 2019 (EP) ..... 19165562

(51) Int. Cl.

| | |
|---|---|
| ***C11D 11/02*** | (2006.01) |
| ***C11D 1/22*** | (2006.01) |
| ***C11D 3/12*** | (2006.01) |
| ***C11D 3/20*** | (2006.01) |
| ***C11D 3/37*** | (2006.01) |
| ***C11D 17/06*** | (2006.01) |
| ***C11D 11/00*** | (2006.01) |

(52) U.S. Cl.

CPC ..... *C11D 11/02* (2013.01); *C11D 1/22* (2013.01); *C11D 3/122* (2013.01); *C11D 3/1246* (2013.01); *C11D 3/2082* (2013.01); *C11D 3/2086* (2013.01); *C11D 3/3761* (2013.01); *C11D 11/0017* (2013.01); *C11D 17/06* (2013.01)

(58) Field of Classification Search

None

See application file for complete search history.

(56) References Cited

U.S. PATENT DOCUMENTS 5,352,604 A 10/1994 Wilson
6,369,020 B1 * 4/2002 Kohlus ..... C11D 1/29 510/276
6,475,972 B1 * 11/2002 Clignet ..... C11D 11/02 510/417
2003/0114347 A1 * 6/2003 Dontula ..... C11D 17/065 510/446
2010/0298188 A1 * 11/2010 Glenn, Jr. ..... A61K 8/046 510/120
2011/0263473 A1 * 10/2011 Somerville Roberts ..... C11D 7/3245 510/229
2012/0153521 A1 6/2012 Cardozo et al.
2016/0289604 A1 10/2016 Tantawy et al.

FOREIGN PATENT DOCUMENTS

| | | | |
|---|---|---|---|
| EP | 0520582 | A1 | 12/1992 |
| EP | 2138565 | A1 | 12/2009 |
| WO | 2005075616 | A1 | 8/2005 |
| WO | 2006002643 | A2 | 1/2006 |
| WO | 2006090335 | A1 | 8/2006 |
| WO | 2008007320 | A2 | 1/2008 |
| WO | 2008087497 | | 7/2008 |
| WO | 2007144857 | A8 | 2/2009 |
| WO | 2009101593 | A3 | 10/2009 |
| WO | 2009069077 | A3 | 1/2010 |
| WO | 2009154933 | A3 | 2/2010 |
| WO | 2010056652 | A1 | 5/2010 |
| WO | 2011072117 | A1 | 6/2011 |
| WO | 2011084412 | A1 | 7/2011 |
| WO | 2011140316 | A4 | 2/2012 |
| WO | 2012054835 | A1 | 4/2012 |
| WO | 2012166768 | A1 | 12/2012 |
| WO | 2013033318 | A1 | 3/2013 |
| WO | 2013116261 | A3 | 9/2013 |
| WO | 2014089386 | A1 | 6/2014 |
| WO | 2013171241 | A9 | 11/2014 |
| WO | 2016161219 | A1 | 10/2016 |

OTHER PUBLICATIONS

European Search Report for Application No./Patent No. 18164686. 0-1106, dated Aug. 1, 2018, 5 pages.
European Search Report for Application No./Patent No. 19165562. 0-1106, dated Aug. 22, 2019, 5 pages.
International Search Report for International Application No. PCT/US2019/024197, dated Jun. 11, 2019, 11 pages.

* cited by examiner

*Primary Examiner* — Lorna M Douyon
(74) *Attorney, Agent, or Firm* — Gary J. Foose

(57) ABSTRACT

The present invention relates to a process for preparing a spray-dried laundry detergent particle, wherein the process includes the step of contacting water-insoluble silicate salt to monomeric organic carboxylic acid in an aqueous mixture, wherein the aqueous mixture has a pH of 4.2 or less, wherein the aqueous mixture includes detersive surfactant, wherein the aqueous mixture is substantially free of carbonate salt, wherein the water-insoluble silicate salt reacts with the monomeric organic carboxylic acid to form silica, wherein the aqueous mixture is spray-dried to form a spray-dried laundry detergent particle, wherein the particle comprises: detersive surfactant; monomeric organic carboxylic acid; and silica, wherein the particle is substantially free of carbonate salt.

14 Claims, No Drawings

PROCESS FOR PREPARING A SPRAY-DRIED LAUNDRY DETERGENT PARTICLE

FIELD OF THE INVENTION

The present invention relates to a process for preparing a spray-dried laundry detergent particle. The particles are substantially free of carbonate salt and have good particle characteristics such as good physical properties, cake strength, flowability as well as good dispensing, dissolution and fabric residue performance (i.e. leave low levels of residue upon laundered fabrics after the laundering process). The particles exhibit a low bulk density.

BACKGROUND OF THE INVENTION

There is a recent trend in the laundry detergent manufacturing industry to provide laundry detergent powder that, upon dissolution with water, generates a wash liquor having a pH typically in the range of from 7.0 to 9.0. Conventional laundry detergent powders today, upon dissolution with water, provide a wash liquor pH in the range of 10.5-11.0, and sometimes higher. Whilst high a wash pH in these typical ranges provide good cleaning performances, it is difficult to provide fabric care benefits. In seeking to improve the fabric care performance of laundry detergent powder, detergent formulators are developing laundry powder that provides a low pH wash liquor. Typically, this necessitates the removal from the powder of bulk ingredients that provide alkalinity to the wash liquor. Such ingredients are typically carbonate salt such as sodium carbonate. These ingredients are often formulated into the laundry powder, not only to provide a wash liquour pH of ~10.5, but also to provide good physical properties to the laundry powder.

The base particle of a laundry detergent powder is typically prepared by a spray-drying process. During this process, detergent ingredients such as detersive surfactant, polymer, filler salt if used, are formed into an aqueous mixture, often called a crutcher mix, and then spray-dried to form a spray-dried laundry detergent particle. This spray-dried particle can be used as a laundry detergent powder product, or (and more usually) the spray-dried particle is mixed with other ingredients such as bleach particles, enzyme particles, perfume, and sometimes additional surfactant particles and other dry-added particles like filler particles such as sodium sulphate particles, to form a fully formulated laundry detergent powder.

The presence of carbonate salt in the spray-dried base particle, provide not only the alkalinity typically used by the detergent formulator to provide good cleaning (~10.5), but also provides good physical characteristics to the spray-dried base detergent particle. Such physical characteristics include good cake strength and good flowability.

However, recent moves to formulate laundry detergent powder, and hence also the spray-dried base detergent powder, at a lower pH, has led to the need to remove ingredients such as carbonate salt from the spray-dried base powder. This in turn has led to problems of poor physical properties in the spray-dried particles that are being developed for use in these low pH laundry powder products.

Ingredients such as silica have been considered as a replacement for the carbonate salt in the spray-dried particle. However, silica is difficult to handle during the manufacturing process. The very low density and small particle size of silica means complicated and elaborate processing equipment and controls will be needed in order to dose silica in a crutcher mix ahead of spray-drying the mixture to form the spray-dried base particle. The behavior of silica during its introduction into the crutcher mixture is often described as gaseous like, or smoke like, and creates many problems such as dusting, and inaccurate dosing.

The inventors have found that rather than introducing silica as a starting material and trying to dose it into the crutcher mixture, silica can instead be formed in-situ in the crutcher mixture by the reaction of a water-insoluble silicate salt, which under controlled pH conditions forms silica in an aqueous environment. In order to do this, the pH of the crutcher mixture must be carefully controlled so as to cause this reaction to take place.

Water-insoluble silicate salts are conventional detergent ingredient that are often in laundry detergent powders. The manufacturing processes and ways of incorporating water-insoluble silicate salts into the crutcher mixture are well understood. However, instead of introducing water-insoluble silicate salts into the spray-dried powder, the inventors have found that water-insoluble silicate salts can be used as a substrate to form silica in-situ during the spray-drying process. The water-insoluble silicate salts converts to silica, and the resultant spray-dried laundry particles are suitable for use not only in low pH laundry powders, but also in low built laundry powder. Since the water-insoluble silicate salts converts to silica during the manufacturing process, the resultant particle also has the dispensing, dissolution and good fabric residue performance profiles of a low built laundry detergent powder.

This process provides a means to produce a spray-dried particle that can be used to formulate a low pH laundry powder, that benefits from the presence of silica, such as good physical characteristics, but without having all of the problems associated with trying to dose silica as a starting ingredient directly into the crutcher mixture. In addition, the particles produced by this process also have good dispensing, dissolution and good fabric residue performance profiles.

Furthermore, low pH laundry powders tend to have a relatively high bulk density. This tendency to produce spray-dried detergent base particles having higher bulk densities can result in issues when the detergent powder needs to meet certain (low) bulk density requirements which the consumers prefer. On a commercial scale, this means that (high) bulk density issues can occur in the spray-drying manufacturing plants, and this increase in bulk density needs to be managed so as to negate the increase in bulk density. This in turn can result in the need for complicated air injection systems, which are expensive and bring their own set of issues which need to addressed, or it can result in the need to lower the production rate of the spray-drying manufacturing plant to ensure that the target low bulk density of the resultant spray-dried laundry powder is met.

The Inventors have found that the process of the present invention results in the formation of a spray-dried powder that has a lower bulk density. The in-situ formation of silica by the process of the present invention lowers the bulk density of the resultant powder. This overcomes the issues of bulk density discussed above and provides a solution of the bulk density issues and avoids the need for reducing the production rate of a commercial spray-drying laundry detergent plant, or introducing any complicated density management system in a commercial spray-drying laundry detergent plant.

SUMMARY OF THE INVENTION

The present invention relates to a process for preparing a spray-dried laundry detergent particle, wherein the process comprises the step of contacting water-insoluble silicate salt to monomeric organic carboxylic acid in an aqueous mixture, wherein the aqueous mixture has a pH of 4.2 or less, wherein the aqueous mixture comprises detersive surfactant, and wherein the aqueous mixture is substantially free of carbonate salt, wherein the water-insoluble silicate salt reacts with the monomeric organic carboxylic acid to form silica, wherein the aqueous mixture is spray-dried to form a spray-dried laundry detergent particle, wherein the particle comprises: detersive surfactant; monomeric organic carboxylic acid; and silica, and wherein the particle is substantially free of carbonate salt.

DETAILED DESCRIPTION OF THE INVENTION

Process for preparing a spray-dried laundry detergent particle: The process for preparing a spray-dried laundry detergent particle, comprises the step of contacting water-insoluble silicate salt to monomeric organic carboxylic acid in an aqueous mixture, wherein the aqueous mixture has a pH of 4.2 or less, wherein the aqueous mixture comprises detersive surfactant, and wherein the aqueous mixture is substantially free of carbonate salt, wherein the water-insoluble silicate salt reacts with the monomeric organic carboxylic acid to form silica, wherein the aqueous mixture is spray-dried to form a spray-dried laundry detergent particle, wherein the particle comprises: detersive surfactant; monomeric organic carboxylic acid; and silica, and wherein the particle is substantially free of carbonate salt.

The steps of forming the aqueous mixture, and spray-drying the aqueous mixture are described in more detail below. The spray-drying process can be carried out using any typical spray-drying equipment. Usually, the equipment includes a mixer, typically called a crutcher mixture. It is not uncommon for second mixers or vessels to be used after the first mixer, a common example of this is a drop tank. Typically, pipes are used, often in combination with one or more pumps to transfer the aqueous mixture from the mixer to a nozzle, where the aqueous mixture is then transferred through the nozzle into a spray-drying tower. Often, a first low pressure pump, followed by a second high pressure pump is used to transfer the aqueous mixture through the pipe.

Forming an aqueous mixture: The aqueous mixture is typically formed by contacting detersive surfactant, monomeric organic carboxylic acid, water-insoluble silicate salt and water, It is highly preferred for the detersive surfactant to be present when water-insoluble silicate salt is contacted with monomeric organic carboxylic acid. The preferred order of addition is to contact detersive surfactant with water, then to contact the monomeric carboxylic acid, and then finally contacting the water-insoluble silicate salt. It is essential that the pH of the aqueous mixture be at 4.2 or less for the production of spray-dried laundry powder having a low bulk density. Preferably, the pH of the aqueous mixture is 3.5 or less. The water-insoluble silicate salt reacts with the monomeric organic carboxylic acid to form silica. Controlling the weight ratio of monomeric organic carboxylic acid to water-insoluble silicate salt is also a preferred feature of the present invention.

The aqueous mixture is substantially free of carbonate salt. By substantially free it is typically meant, no deliberately added. After the formation of silica, it can be useful to introduce some alkalinity back into the aqueous mixture, depending on the desired pH of the wash liquor the detergent formulator desires. However, bulk alkalinity chemistry such as carbonate salt and/or additional silicate salt is not to be used. Alkalinity agents such as NaOH are particularly useful in this regard. Typically, the fully formulated laundry detergent powder for which the spray-dried particle can be included, is to be such that upon dissolution with water at 20° C. and at a concentration of 1 g/L in deionised water, has a pH in the range of from 7.0 to 9.5, preferably from 7.5 to 9.0, or from 7.5 to 8.5. This is considered to be the optimal pH of a low pH laundry detergent powder to provide good fabric care benefits whilst also providing good fabric cleaning performance. The process of the present invention allows the formation of a spray-dried particle having a low pH profile, typically much lower than this optimal pH for the ultimate wash liquor.

Typically, the spray-dried particle has a pH of 6.0 or less, or even 5.0 or less, or 4.2 or less, or even 3.5 or less upon dissolution in de-ionized water at a concentration of 1 g/L and a temperature of 20° C. This pH profile can still be used when formulating a laundry detergent powder, as the spray-dried particle can be combined with other ingredients to raise the pH of the wash liquor back to the ideal pH range described above (e.g. 7.0 to 9.5). For example, the introduction of sodium percarbonate bleach into the laundry powder as a dry-add to be used in combination with the spray-dried base particle is one such alkalinity source. The detergent formulator can take all of this pH effect into account when formulating their desired laundry detergent powder.

Spray-drying the aqueous mixture: Typically, the spray-drying of the aqueous mixture comprises the steps of transferring the aqueous mixture through a pipe leading through a first pump and then through a second pump to a number of spray nozzles. The first pump is typically a low pressure pump, such as a pump that is capable of generating a pressure of from $3\times10^5$ to $1\times10^6$ Pa. Typically, the second pump is a high pressure pump, such as a pump that is capable of generating a pressure of from $2\times10^6$ to $1\times10^7$ Pa. The pressure in the pipe at the outlet of the first pump may be less than $1\times10^6$ Pa. Optionally, the aqueous detergent slurry is transferred through a disintegrator, such as disintegrators supplied by Hosakawa Micron. Typically, disintegrators, is positioned between the pumps. The flow rate of the aqueous detergent slurry along the pipes is typically in the range of from 800 kg/hour to >50,000 kg/hour.

A suitable pressure spray nozzle is a spray systems T4C8 nozzle where multiple nozzles can be used at different levels within the tower. Preferably the aqueous detergent slurry is at a temperature of from 60° C. to 130° C. Suitable spray drying towers are concurrent or counter current spray drying towers, where the latter may be operated as a swirl tower. Preferably, the inlet air temperature to the spray drying tower is in the range of from 220° C. to 350° C. Preferably, the exhaust air temperature to the spray drying tower is in the range of from 60° C. to 100° C. The spray-dried powder may be subjected to cooling, for example an air lift. Typically, the spray dried powder is subjected to particle size classification to remove oversize material (>1.8 mm) to form a spray dried powder which is free flowing. Fine material (<0.15 mm) is elutriated with the exhaust air in the spray drying tower and collected in a post tower dust containment system.

Aqueous mixture: The aqueous mixture has a pH of 4.2 or less, preferably 3.5 or less. Preferably, the weight ratio of monomeric organic carboxylic acid to water-insoluble silicate salt present in the aqueous mixture is at least 1.0, preferably at least 1.2, or even at least 1.2, and most preferably at least 1.6. Having an excess of monomeric organic carboxylic acid to water-insoluble silicate salt ensures good reaction kinetics of the formation of silica and also maintains and enables good pH control of the aqueous mixture.

The aqueous mixture, which can also be known as a crutcher mixture, can also contain other detergent ingredients that are suitable for inclusion into the spray-dried laundry detergent particle. Suitable ingredients are described in more detail below, but include polymers, chelants, hueing dyes, brighteners, colourants and pigments. Preferably, the aqueous mixture comprises carboxylate polymer.

A preferred chemical composition of the aqueous mixture, after the water-insoluble silicate salt has reacted with the monomeric organic carboxylic acid, is such that the aqueous mixture comprises: (a) from 20 wt % to 40 wt % water; (b) from 7.2 wt % to 24 wt % detersive surfactant; (c) from 2.4 wt % to 8 wt % monomeric organic carboxylic acid; (d) from 0.3 wt % to 2.4 wt % silica; (e) optionally, from 1.2 wt % to 8 wt % magnesium sulphate; (f) optionally, from 0.3 wt % to 4 wt % polymer; and (g) optionally, from 21 wt % to 64 wt % sodium sulphate.

Spray-dried laundry detergent particle: The particle comprises: detersive surfactant; monomeric organic carboxylic acid; and silica. The particle is substantially free of carbonate salt. The particle may be substantially free of water-insoluble silicate salt. Other ingredients can be included in the particle, these ingredients are described in more detail below. Preferably, the particle comprises: (a) from 12 wt % to 30 wt % detersive surfactant; (b) from 4 wt % to 10 wt % monomeric organic carboxylic acid; (c) from 0.5 wt % to 3 wt % silica; (d) optionally, from 2 wt % to 10 wt % magnesium sulphate; (e) optionally, from 0.5 wt % to 5 wt % polymer; (f) optionally, from 35 wt % to 80 wt % sodium sulphate; and (g) optionally, from 0 wt % to 6 wt % water.

As mentioned above, the particle may have a pH of 6.0 or less, or 5.0 or less, or 4.2 or less, or 3.5 or less upon dissolution in de-ionized water at a concentration of 10 wt % and a temperature of 25° C. The particle may comprise alkalinity agents, a preferred alkalinity agent is NaOH.

The particle may comprises magnesium sulphate, preferably the particle comprises magnesium sulphate in amorphous form.

The spray-dried particle typically has a bulk density of less than 550 g/l. The method of measuring bulk density is described in more detail below.

The spray-dried particle typically has a weight average particle size of from 300 micrometers to 600 micrometers. The method of measuring weight average particle size is described in more detail below.

Monomeric organic carboxylic acid: The monomeric organic carboxylic acid is preferably a monomeric organic polycarboxylic acid, most preferably citric acid. Suitable acids include: formic acid, acetic acid, propionic acid, butyric acid, caprylic acid and lauric acid, stearic acid, linoleic acid and acrylic acid, methacrylic acid, chloroacetic acid, citric acid, lactic acid, glyoxylic acid, acetoacetic acid, oxalic acid, malonic acid, adipic acid and phenylacetic acid, benzoic acid, salicylic acid, glycine and alanine, valine, aspartic acid, glutamic acid, lysine and phenylalanine, nicotinic acid, picolinic acid, fumaric acid, lactic acid, benzoic acid, glutamic acid; succinic acid, glycolic acid. Preferably, the organic acid is selected from the group citric acid, malic acid, succinic acid, lactic acid, glycolic acid, fumaric acid, tartaric acid, and formic acids and mixtures thereof. More preferably, the acid is citric acid, lactic acid and tartaric acid. Most preferably is citric acid.

Water-insoluble magnesium silicate salt: Suitable water-insoluble silicate salts are water-insoluble magnesium silicates salts. A suitable magnesium silicate salt is talc. A method of measuring water-solubility is described in more detail below.

Detersive surfactant: A preferred detersive surfactant is alkyl benzene sulphonate. Suitable detersive surfactants include anionic detersive surfactants, non-ionic detersive surfactant, cationic detersive surfactants, zwitterionic detersive surfactants and amphoteric detersive surfactants. Suitable detersive surfactants may be linear or branched, substituted or un-substituted, and may be derived from petrochemical material or biomaterial.

Anionic detersive surfactant: Suitable anionic detersive surfactants include sulphonate and sulphate detersive surfactants.

Suitable sulphonate detersive surfactants include methyl ester sulphonates, alpha olefin sulphonates, alkyl benzene sulphonates, especially alkyl benzene sulphonates, preferably $C_{10-13}$ alkyl benzene sulphonate. Suitable alkyl benzene sulphonate (LAS) is obtainable, preferably obtained, by sulphonating commercially available linear alkyl benzene (LAB); suitable LAB includes low 2-phenyl LAB, other suitable LAB include high 2-phenyl LAB, such as those supplied by Sasol under the tradename Hyblene®.

Suitable sulphate detersive surfactants include alkyl sulphate, preferably $C_{8-18}$ alkyl sulphate, or predominantly $C_{12}$ alkyl sulphate.

A preferred sulphate detersive surfactant is alkyl alkoxylated sulphate, preferably alkyl ethoxylated sulphate, preferably a $C_{8-18}$ alkyl alkoxylated sulphate, preferably a $C_{8-18}$ alkyl ethoxylated sulphate, preferably the alkyl alkoxylated sulphate has an average degree of alkoxylation of from 0.5 to 20, preferably from 0.5 to 10, preferably the alkyl alkoxylated sulphate is a $C_{8-18}$ alkyl ethoxylated sulphate having an average degree of ethoxylation of from 0.5 to 10, preferably from 0.5 to 5, more preferably from 0.5 to 3 and most preferably from 0.5 to 1.5.

The alkyl sulphate, alkyl alkoxylated sulphate and alkyl benzene sulphonates may be linear or branched, substituted or un-substituted, and may be derived from petrochemical material or biomaterial.

Other suitable anionic detersive surfactants include alkyl ether carboxylates.

Suitable anionic detersive surfactants may be in salt form, suitable counter-ions include sodium, calcium, magnesium, amino alcohols, and any combination thereof. A preferred counter-ion is sodium.

Non-ionic detersive surfactant: Suitable non-ionic detersive surfactants are selected from the group consisting of: $C_8$-$C_{18}$ alkyl ethoxylates, such as, NEODOL® non-ionic surfactants from Shell; $C_6$-$C_{12}$ alkyl phenol alkoxylates wherein preferably the alkoxylate units are ethyleneoxy units, propyleneoxy units or a mixture thereof; $C_{12}$-$C_{18}$ alcohol and $C_6$-$C_{12}$ alkyl phenol condensates with ethylene oxide/propylene oxide block polymers such as Pluronic® from BASF; alkylpolysaccharides, preferably alkylpolyglycosides; methyl ester ethoxylates; polyhydroxy fatty acid amides; ether capped poly(oxyalkylated) alcohol surfactants; and mixtures thereof.

Suitable non-ionic detersive surfactants are alkylpolyglucoside and/or an alkyl alkoxylated alcohol.

Suitable non-ionic detersive surfactants include alkyl alkoxylated alcohols, preferably $C_{8-18}$ alkyl alkoxylated alcohol, preferably a $C_{8-18}$ alkyl ethoxylated alcohol, preferably the alkyl alkoxylated alcohol has an average degree of alkoxylation of from 1 to 50, preferably from 1 to 30, or from 1 to 20, or from 1 to 10, preferably the alkyl alkoxylated alcohol is a $C_{8-18}$ alkyl ethoxylated alcohol having an average degree of ethoxylation of from 1 to 10, preferably from 1 to 7, more preferably from 1 to 5 and most preferably from 3 to 7. The alkyl alkoxylated alcohol can be linear or branched, and substituted or un-substituted.

Suitable nonionic detersive surfactants include secondary alcohol-based detersive surfactants.

Cationic detersive surfactant: Suitable cationic detersive surfactants include alkyl pyridinium compounds, alkyl quaternary ammonium compounds, alkyl quaternary phosphonium compounds, alkyl ternary sulphonium compounds, and mixtures thereof.

Preferred cationic detersive surfactants are quaternary ammonium compounds having the general formula:

$$(R)(R_1)(R_2)(R_3)N^+X^-$$

wherein, R is a linear or branched, substituted or unsubstituted $C_{6-18}$ alkyl or alkenyl moiety, $R_1$ and $R_2$ are independently selected from methyl or ethyl moieties, $R_3$ is a hydroxyl, hydroxymethyl or a hydroxyethyl moiety, X is an anion which provides charge neutrality, preferred anions include: halides, preferably chloride; sulphate; and sulphonate.

Zwitterionic detersive surfactant: Suitable zwitterionic detersive surfactants include amine oxides and/or betaines.

Carboxylate polymer: A suitable carboxylate polymer includes polymers such as a maleate/acrylate random copolymer or polyacrylate homopolymer. Suitable carboxylate polymers include: polyacrylate homopolymers having a molecular weight of from 4,000 Da to 9,000 Da; maleate/acrylate random copolymers having a molecular weight of from 30,000 Da to 100,000 Da, or from 50,000 Da to 100,000 Da, or from 60,000 Da to 80,000 Da.

Another suitable carboxylate polymer is a co-polymer that comprises: (i) from 50 to less than 98 wt % structural units derived from one or more monomers comprising carboxyl groups; (ii) from 1 to less than 49 wt % structural units derived from one or more monomers comprising sulfonate moieties; and (iii) from 1 to 49 wt % structural units derived from one or more types of monomers selected from ether bond-containing monomers represented by formulas (I) and (II):

formula (I)

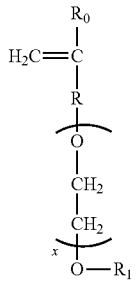

wherein in formula (I), $R_0$ represents a hydrogen atom or $CH_3$ group, R represents a $CH_2$ group, $CH_2CH_2$ group or single bond, X represents a number 0-5 provided X represents a number 1-5 when R is a single bond, and $R_1$ is a hydrogen atom or $C_1$ to $C_{20}$ organic group;

formula (II)

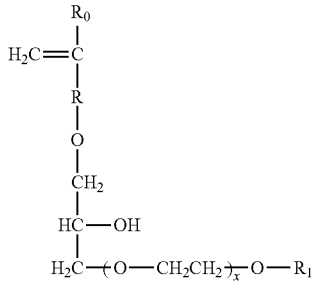

wherein in formula (II), $R_0$ represents a hydrogen atom or $CH_3$ group, R represents a $CH_2$ group, $CH_2CH_2$ group or single bond, X represents a number 0-5, and $R_1$ is a hydrogen atom or $C_1$ to $C_{20}$ organic group.

It may be preferred that the polymer has a weight average molecular weight of at least 30 kDa, or at least 50 kDa, or even at least 70 kDa.

Solid free-flowing particulate laundry detergent composition: Typically, the spray-dried particle prepared by the process of the present invention can be combined with other particles to form a solid free-flowing particulate laundry detergent composition that is a fully formulated laundry detergent powder composition. Typically, the solid composition comprises a plurality of chemically different particles, such as the spray-dried base detergent particle in combination with one or more agglomerated detergent particles and/or extruded detergent particles. The spray-dried particle may be used in combination with one or more, typically two or more, or five or more, or even ten or more particles selected from: surfactant particles, including surfactant agglomerates, surfactant extrudates, surfactant needles, surfactant noodles, surfactant flakes; phosphate particles; zeolite particles; polymer particles such as carboxylate polymer particles, cellulosic polymer particles, starch particles, polyester particles, polyamine particles, terephthalate polymer particles, polyethylene glycol particles; aesthetic particles such as coloured noodles, needles, lamellae particles and ring particles; enzyme particles such as protease granulates, amylase granulates, lipase granulates, cellulase granulates, mannanase granulates, pectate lyase granulates, xyloglucanase granulates, bleaching enzyme granulates and co-granulates of any of these enzymes, preferably these enzyme granulates comprise sodium sulphate; bleach particles, such as percarbonate particles, especially coated percarbonate particles, such as percarbonate coated with carbonate salt, sulphate salt, silicate salt, borosilicate salt, or any combination thereof, perborate particles, bleach activator particles such as tetra acetyl ethylene diamine particles and/or alkyl oxybenzene sulphonate particles, bleach catalyst particles such as transition metal catalyst particles, and/or isoquinolinium bleach catalyst particles, pre-formed peracid particles, especially coated pre-formed peracid particles; filler particles such as sulphate salt particles and chloride particles; clay particles such as montmorillonite particles and particles of clay and silicone; flocculent particles such as polyethylene oxide particles; wax particles such as wax agglomerates; silicone particles, brightener particles; dye transfer inhibition particles; dye fixative particles; perfume particles such as perfume microcapsules and starch encapsulated perfume accord particles, or pro-perfume particles such as Schiff base reaction product particles; hueing dye particles; chelant particles such as chelant agglomerates; and any combination thereof.

The composition may comprise: silicate salt particles, especially sodium silicate particles; and/or carbonate salt particles, especially sodium bicarbonate particles. However it may be preferred for the composition to be free of silicate salt particles, especially free of sodium silicate particles. It may also be preferred for the composition to be free of carbonate salt particles, especially free of sodium carbonate particles.

Preferably, the composition comprises from 1 wt % to 10 wt % dry-added acid particles, preferably from 2 wt % to 8 wt % dry-added acid particles. A suitable dry-added acid is an organic acid, preferably a carboxylic acid, preferably citric acid.

Detergent Ingredients: Suitable laundry detergent compositions comprise a detergent ingredient selected from: detersive surfactant, such as anionic detersive surfactants, nonionic detersive surfactants, cationic detersive surfactants, zwitterionic detersive surfactants and amphoteric detersive surfactants; polymers, such as carboxylate polymers, soil release polymer, anti-redeposition polymers, cellulosic polymers and care polymers; bleach, such as sources of hydrogen peroxide, bleach activators, bleach catalysts and pre-formed peracids; photobleach, such as such as zinc and/or aluminium sulphonated phthalocyanine; enzymes, such as proteases, amylases, cellulases, lipases; zeolite builder; phosphate builder; co-builders, such as citric acid and citrate; sulphate salt, such as sodium sulphate; chloride salt, such as sodium chloride; brighteners; chelants; hueing agents; dye transfer inhibitors; dye fixative agents; perfume; silicone; fabric softening agents, such as clay; flocculants, such as polyethyleneoxide; suds suppressors; and any combination thereof.

The composition may comprise: silicate salt, especially sodium silicate; and/or carbonate salt, especially sodium bicarbonate and/or sodium carbonate. However it may be preferred for the composition to be free of silicate salt, especially free of sodium silicate. It may also be preferred for the composition to be free of carbonate salt, especially free of sodium carbonate and/or sodium bicarbonate.

The composition may have a pH profile such that upon dilution in de-ionized water at a concentration of 1 g/L at a temperature of 20° C., the composition has a pH in the range of from 7.0 to 9.5, or from 7.0 to 9.0, or from 7.0 to 8.5, or even from 7.5 to 8.5.

Suitable laundry detergent compositions may have a low buffering capacity. Such laundry detergent compositions typically have a reserve alkalinity to pH 7.5 of less than 5.0 g NaOH/100 g, preferably less than 3.0 g NaOH/100 g.

The composition is preferably substantially free of preformed peracid. The composition is preferably substantially free of phthalimido-peroxycaproic acid. Substantially free means no deliberately added.

Detersive Surfactant: Suitable detersive surfactants are described above.

Polymer: Suitable polymers include carboxylate polymers, soil release polymers, anti-redeposition polymers, cellulosic polymers, care polymers and any combination thereof.

Carboxylate polymer: Suitable carboxylate polymers are described above.

Soil release polymer: The composition may comprise a soil release polymer. A suitable soil release polymer has a structure as defined by one of the following structures (I), (II) or (III):

$$—[(OCHR^1—CHR^2)_a—O—OC—Ar—CO—]_d \quad (I)$$

$$—[(OCHR^3—CHR^4)_b—O—OC—Ar—CO—]_e \quad (II)$$

$$—[(OCHR^5—CHR^6)_c—OR^7]_f \quad (III)$$

wherein:

a, b and c are from 1 to 200;

d, e and f are from 1 to 50;

Ar is a 1,4-substituted phenylene;

sAr is 1,3-substituted phenylene substituted in position 5 with $SO_3Me$;

Me is Li, K, Mg/2, Ca/2, Al/3, ammonium, mono-, di-, tri-, or tetraalkylammonium wherein the alkyl groups are $C_1$-$C_{18}$ alkyl or $C_2$-$C_{10}$ hydroxyalkyl, or mixtures thereof;

$R^1$, $R^2$, $R^3$, $R^4$, $R^5$ and $R^6$ are independently selected from H or $C_1$-$C_{18}$ n- or iso-alkyl; and $R^7$ is a linear or branched $C_1$-$C_{18}$ alkyl, or a linear or branched $C_2$-$C_{30}$ alkenyl, or a cycloalkyl group with 5 to 9 carbon atoms, or a $C_8$-$C_{30}$ aryl group, or a $C_6$-$C_{30}$ arylalkyl group.

Suitable soil release polymers are sold by Clariant under the TexCare® series of polymers, e.g. TexCare® SRN240 and TexCare® SRA300. Other suitable soil release polymers are sold by Solvay under the Repel-o-Tex® series of polymers, e.g. Repel-o-Tex® SF2 and Repel-o-Tex® Crystal.

Anti-redeposition polymer: Suitable anti-redeposition polymers include polyethylene glycol polymers and/or polyethyleneimine polymers.

Suitable polyethylene glycol polymers include random graft co-polymers comprising: (i) hydrophilic backbone comprising polyethylene glycol; and (ii) hydrophobic side chain(s) selected from the group consisting of: $C_4$-$C_{25}$ alkyl group, polypropylene, polybutylene, vinyl ester of a saturated $C_1$-$C_6$ mono-carboxylic acid, $C_1$-$C_6$ alkyl ester of acrylic or methacrylic acid, and mixtures thereof. Suitable polyethylene glycol polymers have a polyethylene glycol backbone with random grafted polyvinyl acetate side chains. The average molecular weight of the polyethylene glycol backbone can be in the range of from 2,000 Da to 20,000 Da, or from 4,000 Da to 8,000 Da. The molecular weight ratio of the polyethylene glycol backbone to the polyvinyl acetate side chains can be in the range of from 1:1 to 1:5, or from 1:1.2 to 1:2. The average number of graft sites per 50 ethylene oxide units can be less than 1, or less than 0.8, the average number of graft sites per ethylene oxide units can be in the range of from 0.5 to 0.9, or the average number of graft sites per ethylene oxide units can be in the range of from 0.1 to 0.5, or from 0.2 to 0.4. A suitable polyethylene glycol polymer is Sokalan HP22. Suitable polyethylene glycol polymers are described in WO08/007320.

Cellulosic polymer: Suitable cellulosic polymers are selected from alkyl cellulose, alkyl alkoxyalkyl cellulose, carboxyalkyl cellulose, alkyl carboxyalkyl cellulose, sulphoalkyl cellulose, more preferably selected from carboxymethyl cellulose, methyl cellulose, methyl hydroxyethyl cellulose, methyl carboxymethyl cellulose, and mixtures thereof.

Suitable carboxymethyl celluloses have a degree of carboxymethyl substitution from 0.5 to 0.9 and a molecular weight from 100,000 Da to 300,000 Da.

Suitable carboxymethyl celluloses have a degree of substitution greater than 0.65 and a degree of blockiness greater than 0.45, e.g. as described in WO09/154933.

Care polymers: Suitable care polymers include cellulosic polymers that are cationically modified or hydrophobically modified. Such modified cellulosic polymers can provide anti-abrasion benefits and dye lock benefits to fabric during the laundering cycle. Suitable cellulosic polymers include cationically modified hydroxyethyl cellulose.

Other suitable care polymers include dye lock polymers, for example the condensation oligomer produced by the condensation of imidazole and epichlorhydrin, preferably in ratio of 1:4:1. A suitable commercially available dye lock polymer is Polyquart® FDI (Cognis).

Other suitable care polymers include amino-silicone, which can provide fabric feel benefits and fabric shape retention benefits.

Bleach: Suitable bleach includes sources of hydrogen peroxide, bleach activators, bleach catalysts, pre-formed peracids and any combination thereof. A particularly suitable bleach includes a combination of a source of hydrogen peroxide with a bleach activator and/or a bleach catalyst.

Source of hydrogen peroxide: Suitable sources of hydrogen peroxide include sodium perborate and/or sodium percarbonate.

Bleach activator: Suitable bleach activators include tetra acetyl ethylene diamine and/or alkyl oxybenzene sulphonate.

Bleach catalyst: The composition may comprise a bleach catalyst. Suitable bleach catalysts include oxaziridinium bleach catalysts, transition metal bleach catalysts, especially manganese and iron bleach catalysts. A suitable bleach catalyst has a structure corresponding to general formula below:

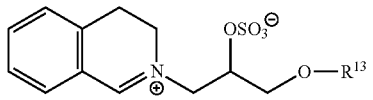

wherein $R^{13}$ is selected from the group consisting of 2-ethylhexyl, 2-propylheptyl, 2-butyloctyl, 2-pentylnonyl, 2-hexyldecyl, n-dodecyl, n-tetradecyl, n-hexadecyl, n-octadecyl, iso-nonyl, iso-decyl, iso-tridecyl and iso-pentadecyl.

Pre-formed peracid: Suitable pre-form peracids include phthalimido-peroxycaproic acid.

Enzymes: Suitable enzymes include lipases, proteases, cellulases, amylases and any combination thereof.

Protease: Suitable proteases include metalloproteases and/or serine proteases. Examples of suitable neutral or alkaline proteases include: subtilisins (EC 3.4.21.62); trypsin-type or chymotrypsin-type proteases; and metalloproteases. The suitable proteases include chemically or genetically modified mutants of the aforementioned suitable proteases.

Suitable commercially available protease enzymes include those sold under the trade names Alcalase®, Savinase®, Primase®, Durazym®, Polarzyme®, Kannase®, Liquanase®, Liquanase Ultra®, Savinase Ultra®, Ovozyme®, Neutrase®, Everlase® and Esperase® by Novozymes A/S (Denmark), those sold under the tradename Maxatase®, Maxacal®, Maxapem®, Preferenz P® series of proteases including Preferenz® P280, Preferenz® P281, Preferenz® P2018-C, Preferenz® P2081-WE, Preferenz® P2082-EE and Preferenz® P2083-A/J, Properase®, Purafect®, Purafect Prime®, Purafect Ox®, FN3®, FN4®, Excellase® and Purafect OXP® by DuPont, those sold under the tradename Opticlean® and Optimase® by Solvay Enzymes, those available from Henkel/Kemira, namely BLAP (sequence shown in FIG. 29 of U.S. Pat. No. 5,352,604 with the following mutations S99D+S101R+S103A+V104I+G159S, hereinafter referred to as BLAP), BLAP R (BLAP with S3T+V4I+V199M+V205I+L217D), BLAP X (BLAP with S3T+V4I+V205I) and BLAP F49 (BLAP with S3T+V4I+A194P+V199M+V205I+L217D)—all from Henkel/Kemira; and KAP (*Bacillus alkalophilus subtilisin* with mutations A230V+S256G+S259N) from Kao.

A suitable protease is described in WO11/140316 and WO11/072117.

Amylase: Suitable amylases are derived from AA560 alpha amylase endogenous to *Bacillus* sp. DSM 12649, preferably having the following mutations: R118K, D183*, G184*, N195F, R320K, and/or R458K. Suitable commercially available amylases include Stainzyme®, Stainzyme® Plus, Natalase, Termamyl®, Termamyl® Ultra, Liquezyme® SZ, Duramyl®, Everest® (all Novozymes) and Spezyme® AA, Preferenz S® series of amylases, Purastar® and Purastar® Ox Am, Optisize® HT Plus (all Du Pont).

A suitable amylase is described in WO06/002643.

Cellulase: Suitable cellulases include those of bacterial or fungal origin. Chemically modified or protein engineered mutants are also suitable. Suitable cellulases include cellulases from the genera *Bacillus, Pseudomonas, Humicola, Fusarium, Thielavia, Acremonium*, e.g., the fungal cellulases produced from *Humicola insolens, Myceliophthora thermophila* and *Fusarium oxysporum.*

Commercially available cellulases include Celluzyme®, Carezyme®, and Carezyme® Premium, Celluclean® and Whitezyme® (Novozymes A/S), Revitalenz® series of enzymes (Du Pont), and Biotouch® series of enzymes (AB Enzymes). Suitable commercially available cellulases include Carezyme® Premium, Celluclean® Classic. Suitable cellulases are described in WO07/144857 and WO10/056652.

Lipase: Suitable lipases include those of bacterial, fungal or synthetic origin, and variants thereof. Chemically modified or protein engineered mutants are also suitable. Examples of suitable lipases include lipases from *Humicola* (synonym *Thermomyces*), e.g., from *H. lanuginosa* (*T. lanuginosus*).

The lipase may be a "first cycle lipase", e.g. such as those described in WO06/090335 and WO13/116261. In one aspect, the lipase is a first-wash lipase, preferably a variant of the wild-type lipase from *Thermomyces lanuginosus* comprising T231R and/or N233R mutations. Preferred lipases include those sold under the tradenames Lipex®, Lipolex® and Lipoclean® by Novozymes, Bagsvaerd, Denmark.

Other suitable lipases include: Liprl 139, e.g. as described in WO2013/171241; and TfuLip2, e.g. as described in WO2011/084412 and WO2013/033318.

Other enzymes: Other suitable enzymes are bleaching enzymes, such as peroxidases/oxidases, which include those of plant, bacterial or fungal origin and variants thereof. Commercially available peroxidases include Guardzyme® (Novozymes A/S). Other suitable enzymes include choline oxidases and perhydrolases such as those used in Gentle Power Bleach™.

Other suitable enzymes include pectate lyases sold under the tradenames X-Pect®, Pectaway® (from Novozymes A/S, Bagsvaerd, Denmark) and PrimaGreen® (DuPont) and mannanases sold under the tradenames Mannaway® (Novozymes A/S, Bagsvaerd, Denmark), and Mannastar® (Du Pont).

Other suitable enzymes include nuclease enzymes, such as deoxyribonuclease enzyme.

Zeolite builder: The composition may comprise zeolite builder. The composition may comprise from 0 wt % to 5 wt % zeolite builder, or 3 wt % zeolite builder. The composition may even be substantially free of zeolite builder; substantially free means "no deliberately added". Typical zeolite builders include zeolite A, zeolite P and zeolite MAP.

Phosphate builder: The composition may comprise phosphate builder. The composition may comprise from 0 wt % to 5 wt % phosphate builder, or to 3 wt %, phosphate builder. The composition may even be substantially free of phosphate builder; substantially free means "no deliberately added". A typical phosphate builder is sodium tri-polyphosphate.

Carbonate salt: The composition may comprise carbonate salt. The composition may comprise from 0 wt % to 5 wt % carbonate salt. The composition may even be substantially free of carbonate salt; substantially free means "no deliberately added". Suitable carbonate salts include sodium carbonate and sodium bicarbonate.

Silicate salt: The composition may comprise silicate salt. The composition may comprise from 0 wt % to 5 wt % silicate salt. The composition may even be substantially free of silicate salt; substantially free means "no deliberately added". A preferred silicate salt is sodium silicate, especially preferred are sodium silicates having a $Na_2O:SiO_2$ ratio of from 1.0 to 2.8, preferably from 1.6 to 2.0.

Sulphate salt: A suitable sulphate salt is sodium sulphate.

Brightener: Suitable fluorescent brighteners include: di-styryl biphenyl compounds, e.g. Tinopal® CBS-X, di-amino stilbene di-sulfonic acid compounds, e.g. Tinopal® DMS pure Xtra and Blankophor® HRH, and Pyrazoline compounds, e.g. Blankophor® SN, and coumarin compounds, e.g. Tinopal® SWN.

Preferred brighteners are: sodium 2 (4-styryl-3-sulfophenyl)-2H-napthol[1,2-d]triazole, disodium 4,4'-bis{[(4-anilino-6-(N methyl-N-2 hydroxyethyl)amino 1,3,5-triazin-2-yl)]amino}stilbene-2-2' disulfonate, disodium 4,4'-bis{[(4-anilino-6-morpholino-1,3,5-triazin-2-yl)]amino}stilbene-2-2' disulfonate, and disodium 4,4'-bis(2-sulfostyryl)biphenyl. A suitable fluorescent brightener is C.I. Fluorescent Brightener 260, which may be used in its beta or alpha crystalline forms, or a mixture of these forms.

Chelant: The composition may also comprise a chelant selected from: diethylene triamine pentaacetate, diethylene triamine penta(methyl phosphonic acid), ethylene diamine-N'N'-disuccinic acid, ethylene diamine tetraacetate, ethylene diamine tetra(methylene phosphonic acid) and hydroxyethane di(methylene phosphonic acid). A preferred chelant is ethylene diamine-N'N'-disuccinic acid (EDDS) and/or hydroxyethane diphosphonic acid (HEDP). The composition preferably comprises ethylene diamine-N'N'-disuccinic acid or salt thereof. Preferably the ethylene diamine-N'N'-disuccinic acid is in S,S enantiomeric form. Preferably the composition comprises 4,5-dihydroxy-m-benzenedisulfonic acid disodium salt. Preferred chelants may also function as calcium carbonate crystal growth inhibitors such as: 1-hydroxyethanediphosphonic acid (HEDP) and salt thereof; N,N-dicarboxymethyl-2-aminopentane-1,5-dioic acid and salt thereof; 2-phosphonobutane-1,2,4-tricarboxylic acid and salt thereof; and combination thereof. A suitable chelant is MGDA.

Hueing agent: Suitable hueing agents include small molecule dyes, typically falling into the Colour Index (C.I.) classifications of Acid, Direct, Basic, Reactive (including hydrolysed forms thereof) or Solvent or Disperse dyes, for example classified as Blue, Violet, Red, Green or Black, and provide the desired shade either alone or in combination. Preferred such hueing agents include Acid Violet 50, Direct Violet 9, 66 and 99, Solvent Violet 13 and any combination thereof.

Many hueing agents are known and described in the art which may be suitable for the present invention, such as hueing agents described in WO2014/089386.

Suitable hueing agents include phthalocyanine and azo dye conjugates, such as described in WO2009/069077.

Suitable hueing agents may be alkoxylated. Such alkoxylated compounds may be produced by organic synthesis that may produce a mixture of molecules having different degrees of alkoxylation. Such mixtures may be used directly to provide the hueing agent, or may undergo a purification step to increase the proportion of the target molecule. Suitable hueing agents include alkoxylated bis-azo dyes, such as described in WO2012/054835, and/or alkoxylated thiophene azo dyes, such as described in WO2008/087497 and WO2012/166768.

The hueing agent may be incorporated into the detergent composition as part of a reaction mixture which is the result of the organic synthesis for a dye molecule, with optional purification step(s). Such reaction mixtures generally comprise the dye molecule itself and in addition may comprise un-reacted starting materials and/or by-products of the organic synthesis route. Suitable hueing agents can be incorporated into hueing dye particles, such as described in WO 2009/069077.

Dye transfer inhibitors: Suitable dye transfer inhibitors include polyamine N-oxide polymers, copolymers of N-vinylpyrrolidone and N-vinylimidazole, polyvinylpyrrolidone, polyvinyloxazolidone, polyvinylimidazole and mixtures thereof. Preferred are poly(vinyl pyrrolidone), poly(vinylpyridine betaine), poly(vinylpyridine N-oxide), poly(vinyl pyrrolidone-vinyl imidazole) and mixtures thereof. Suitable commercially available dye transfer inhibitors include PVP-K15 and K30 (Ashland), Sokalan® HP165, HP50, HP53, HP59, HP56K, HP56, HP66 (BASF), Chromabond® S-400, S403E and S-100 (Ashland).

Perfume: Suitable perfumes comprise perfume materials selected from the group: (a) perfume materials having a ClogP of less than 3.0 and a boiling point of less than 250° C. (quadrant 1 perfume materials); (b) perfume materials having a ClogP of less than 3.0 and a boiling point of 250° C. or greater (quadrant 2 perfume materials); (c) perfume materials having a ClogP of 3.0 or greater and a boiling point of less than 250° C. (quadrant 3 perfume materials); (d) perfume materials having a ClogP of 3.0 or greater and a boiling point of 250° C. or greater (quadrant 4 perfume materials); and (e) mixtures thereof.

It may be preferred for the perfume to be in the form of a perfume delivery technology. Such delivery technologies further stabilize and enhance the deposition and release of perfume materials from the laundered fabric. Such perfume delivery technologies can also be used to further increase the longevity of perfume release from the laundered fabric. Suitable perfume delivery technologies include: perfume microcapsules, pro-perfumes, polymer assisted deliveries, molecule assisted deliveries, fiber assisted deliveries, amine assisted deliveries, cyclodextrin, starch encapsulated accord, zeolite and other inorganic carriers, and any mixture thereof. A suitable perfume microcapsule is described in WO2009/101593.

Silicone: Suitable silicones include polydimethylsiloxane and amino-silicones. Suitable silicones are described in WO05075616.

Method of measuring bulk density: A suitable method of measuring bulk density is adapted from the ISO method number 3424 1975E. Using the specifications described in the ISO method which comprises of a funnel with a lid at the bottom to temporarily hold the powder to be measured and a 500 mL cup. Bulk density is measured by placing the powder sample on the funnel while the bottom lid is closed. The cylindrical 500 mL cup is weighed and tared on a balance with at least 2 decimal places. The cup is then placed at the bottom of the funnel. Powder is released from the funnel freely by opening the lid, allowing the powder to flow freely and fill the cup. Using a straight edge, carefully level the powder in a serrated motion avoiding additional vibration. Once the powder has been levelled, the cup which had been previously tared on the balance is then weighed. The weight of the powder in 500 ml container is multiplied by 2 to get the bulk density as grams per Liter Method of measuring weight average particle size: Weight average particle can be measured using a dynamic image analyzer (e.g. CamSizer by Retzsch). Powder samples are taken online by an automatic sampler. Approximately 15 g of blown powder is sampled and measured using a vibratory aluminium feeder with speed start level set at 40% and a nominal area of 3%. The particles drop between a planar light source with two CCD cameras. The particles projected shadows are analysed and median particle size (D50) is calculated using the software provided by the manufacturer based on the calculated volume assuming a spherically shaped particle. The analysis takes approximately 1200 images within 1 minute.

Method of measuring water-solubility: A suitable method uses 2 grams (on a solid basis, excluding water content) of a sample (such as a silicate salt) in a 100 g total solution using a deionised water. The sample is kept at 20° C. by using a water bath as needed. The mixture is placed in a 500 mL beaker with a diameter 80 mm and a stirrer bar length of 50 mm set at 500 rpm. The mixture is mixed for 30 minutes to allow dissolution and/or dispersion of the samples. Once the mixture has been thoroughly mixed, it is then passed through a stainless steel filter with an aperture size of 25 micrometers (25 microns). The filtration uses a 3-piece glass Buchner funnel (9 cm diameter), 1 L flask and a vacuum pump with water trap and a 9 cm diameter stainless steel filter. A pre-weighed stainless steel dry filter is placed on the Buchner funnel. While the vacuum pump is on, the mixture that has been previously mixed is then poured onto the filter. Once all the liquid has thoroughly drain out of the filter, the vacuum pump is stopped. The stainless steel filter with the wet residue is then dried inside at 100° C. oven for 24 hours. The filter is then reweighed. The difference between this and the initial weight prior to the filtration is taken as the weight of insoluble retained on the filter. % insoluble is calculated. For the purpose of the present invention, typically, any silicate salt having less 0.50% or more insoluble in the above described method is considered to be a water-insoluble silicate salt.

Sodium silicate 1.6R left 0.135% insolubles. Magnesium silicate left 69.06% insolubles.

EXAMPLES

Example 1

Magnesium Silicate (Talc) as Source of $SiO_2$

Slurry Composition

Example 1A-Insoluble Silicate example - Low pH

| Sequence of Addition | Name | RM Active | Active Solids Content | Miscellaneous | Water | % Addition |
|---|---|---|---|---|---|---|
| 3 | Citric acid | 100% | 4.7619 | 0.0000 | 0.0000 | 4.7619 |
| 4 | Hydrophobically modified acrylic base polymer | 43% | 1.8571 | 0.0000 | 2.4618 | 4.3189 |
| 2 | C12-14 Alkyl Benzene Sulphonate Paste | 45% | 13.9286 | 0.9286 | 16.0952 | 30.9524 |
| 6 | MgSO4 | 98% | 2.8929 | 0.0000 | 0.0590 | 2.9519 |
| 7 | Na2SO4 | 100% | 44.5198 | 0.0000 | 0.0000 | 44.5198 |
| 5 | Hydrated Magnesium Silicate (Talc)* | 100% | 1.1111 | 0.0000 | 0.0000 | 1.1111 |
| 1 | Added Water | 100% | 0.0000 | 0.0000 | 11.3839 | 11.3839 |
| | Total | | | | 30.0000 | 100.0000 |

*SiO2 from Talc (0.7035%) assuming complete dissolution, computed as follows;

% SiO2 in Talc = (WtT/379 * 4 * 60)/WtT *100

Where WtT = weight of Talc in grams

Weight of monomeric organic carboxylic acid/Weight of water

Insoluble metal silicate = 4.7619/1.1111 = 4.2857

Example 1B -Insoluble Silicate example - High pH

| Sequence of Addition | Name | RM Active | Active Solids Content | Miscellaneous | Water | % Addition |
|---|---|---|---|---|---|---|
| 3 | Sodium Hydroxide Solution | 50% | 3.4545 | 0.0000 | 3.4532 | 6.9077 |

-continued

| Example 1B -Insoluble Silicate example - High pH | | | | | | |
|---|---|---|---|---|---|---|
| Sequence of Addition | Name | RM Active | Active Solids Content | Miscellaneous | Water | % Addition |
| 4 | Citric acid | 100% | 4.8383 | 0.0000 | 0.0000 | 4.8383 |
| 5 | Hydrophobically modified acrylic base polymer | 43% | 1.8869 | 0.0000 | 2.5013 | 4.3882 |
| 2 | C12-14 Alkyl Benzene Sulphonate Paste | 45% | 14.1520 | 0.9435 | 16.3534 | 31.4488 |
| 7 | MgSO4 | 98% | 2.9393 | 0.0000 | 0.0600 | 2.9992 |
| 8 | Na2SO4 | 100% | 40.6566 | 0.0000 | 0.0000 | 40.6566 |
| 6 | Hydrated Magnesium Silicate (Talc)** | 100% | 1.1289 | 0.0000 | 0.0000 | 1.1289 |
| 1 | Added Water | 100% | 0.0000 | 0.0000 | 7.6322 | 7.6322 |
| | Total | | | | 30.0000 | 100.0000 |

**No formation of SiO2 from Talc

Method of Slurry Preparation: Detergent slurries were prepared using a hot water jacketed, top entry mixer with anchor blades and a separate high shear flat blade disperser. The batch size was fixed at 55 kg and the end of the batch temperature was set at 85° C. Materials were added sequentially one by one as shown on the table for each example. Anchor blade rpm was set to 50 rpm from the beginning and was changed to 90 rpm prior to the addition of $Na2SO_4$. High shear disperser was turned on at 1000 rpm while sodium sulphate powder was being added to the crutcher. Once all the ingredients have been added, the recycle line was turned on, keeping the high shear disperser on for the next 5 minutes. Batch cycle time was around 30 minutes.

Once this was completed, the high shear disperser and the recirculation was turned off. The flow was then diverted to the atomizing nozzle. Prior to the atomizing nozzle, the slurry at around 3 to 4 bar was pumped through an IKA rotor stator high speed mixer. Once it passed the high-speed mixer, it went to the externally atomized 2-fluid nozzle with an internal diameter of 2 mm. Slurry rates were kept constant at an average of 40 kg/hr for all the batches.

Spray drying: A fluidised spray dryer was used to dry the slurries to blown granules. The dryer consists of a spray dryer chamber and a 2-stage fluid bed dryer at the bottom of the spray drying chamber. The inlet air which entered at the top of the main chamber had a temperature of 300° C. which was kept constant throughout. Exhaust air exited from the top of the main chamber along with the fines. Fines were separated via cyclone from the exhaust air and recycled back to the top of the main chamber. The outer fluid bed temperature was kept in the range of 85 to 105° C. while the inner bed temperature was varied to achieve a blown powder moisture between 1 to 2%. The powder that came out of the fluid bed was conveyed to the sampling points for pH, particle size and bulk density analysis.

For example 1A, the pH of the aqueous mixture, measured at 10% solution at 20° C. when the source of silica (talc) was contacted to the citric acid (addition sequence 5) was 2.784. For example 1B, the pH of the aqueous mixture, measured at 10% solution at 20° C., when the source of silica (Hydrated Magnesium Silicate-Talc) was contacted to the citric acid (addition sequence 6) was 12.188.

Blown Powder Composition

| Insoluble Silicate Example-Low pH | |
|---|---|
| Name | BP Composition |
| Citric Acid (a) | 3.6467 |
| Monosodium Citrate (a) | 2.9667 |
| Disodium Citrate (a) | 0.0533 |
| Hydrophobically modified acrylic base polymer | 2.6000 |
| C12-14 Alkyl Benzene Sulphonate Paste | 19.5000 |
| MgSO4 | 4.0500 |
| Na2SO4 | 62.3278 |
| SiO2 from Talc | 0.9850 |
| Added Water | 2.0000 |
| Miscellaneous | 1.8706 |
| Total | 100.0000 |

| Insoluble Silicate Example-High pH | |
|---|---|
| Name | BP Composition |
| Trisodium Citrate*** | 8.9590 |
| Hydrophobically modified acrylic base polymer | 2.6000 |
| C12-14 Alkyl Benzene Sulphonate Paste | 19.5000 |
| MgSO4 | 4.0500 |
| Na2SO4 | 60.0354 |
| Talc | 1.5556 |
| Water | 2.0000 |
| Miscellaneous | 1.3000 |
| Total | 100.0000 |

***Trisodium Citrate level was calculated using the chemical equation for the reaction of citric acid and sodium hydroxide assuming citric acid has been the limiting reagent and has fully converted to Trisodium Citrate $C_6H_8O_7 + 3NaOH \rightarrow Na_3C_6H_5O_7 + 3H2O$ WtTC = WtC/192 * 258

Where WtTC = weight of Trisodium Citrate in kg, WtC = weight of Citric Acid in kg (a) Citric Acid form speciation at pH=3 were estimated to have the following composition based on the figure below:

| Citric/ Citrate form present | Estimated Composition at pH = 3 | Equivelent Composition at 6.6667 parts of added Citric Acid |
|---|---|---|
| Citric Acid | 54.70% | 3.6467 |
| Monosodium Citrate | 44.50% | 2.9667 |
| Disodium Citrate | 0.80% | 0.0533 |

Equivalent compositions were calculated based on Henderson-Hasselbalch equations.

Fresh blown powder samples were taken during production and several properties were measured including pH, bulk density and particle size.

| Sample | Blown Powder pH, 10% Solution | Bulk density, gL | Median Particle Size, microns |
|---|---|---|---|
| Example 1A (invention) | 2.91 | 506 | 344 |
| Example 1B (comparative example) | 9.68 | 686 | 350 |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

What is claimed is:

1. A process for preparing a spray-dried laundry detergent particle, wherein the process comprises the step of contacting water-insoluble magnesium silicate salt to monomeric organic polycarboxylic acid in an aqueous mixture, wherein the aqueous mixture has a pH of about 4.2 or less, wherein the aqueous mixture comprises detersive surfactant, wherein the aqueous mixture is substantially free of carbonate salt, wherein the water-insoluble magnesium silicate salt reacts with the monomeric organic polycarboxylic acid to form silica; and spray drying the aqueous mixture in a spray drying tower having an inlet air temperature in a range of from 220° C. to 350° C. to form a spray-dried laundry detergent particle, wherein the particle comprises: detersive surfactant; monomeric organic polycarboxylic acid; and silica, and wherein the particle is substantially free of carbonate salt.

2. A process according claim 1, wherein the aqueous mixture has a pH of about 3.5 or less.

3. A process according to claim 1, wherein the particle has a pH of about 6.0 or less, upon dissolution in de-ionized water at a concentration of about 10 wt % and a temperature of about 25° C.

4. A process according to claim 1, wherein the particle has a pH of about 4.2 or less, upon dissolution in de-ionized water at a concentration of about 10 wt % and a temperature of about 25° C.

5. A process according to claim 1, wherein the particle has a pH of about 3.5 or less, upon dissolution in de-ionized water at a concentration of about 10 wt % and a temperature of about 20° C.

6. A process according to claim 1, wherein the monomeric organic polycarboxylic acid is citric acid.

7. A process according to claim 1, wherein the detersive surfactant is alkyl benzene sulphonate.

8. A process according to claim 1, wherein the weight ratio of monomeric organic polycarboxylic acid to water-insoluble magnesium silicate salt present in the aqueous mixture is at least about 1.6.

9. A process according to claim 1, wherein the aqueous mixture further comprises magnesium sulphate, and wherein the particle further comprises magnesium sulphate in amorphous form.

10. A process according to claim 1, wherein the aqueous mixture further comprises carboxylate polymer, and wherein the particle further comprises carboxylate polymer.

11. A process according to claim 1, wherein the particle comprises:

(a) from about 12 wt % to about 30 wt % detersive surfactant;

(b) from about 4 wt % to about 10 wt % monomeric organic polycarboxylic acid; and (c) from about 0.5 wt % to about 3 wt % silica.

12. A process according to claim 1, wherein after the water-insoluble magnesium silicate salt has reacted with the monomeric organic polycarboxylic acid, the aqueous mixture comprises:

(a) from about 20 wt % to about 40 wt % water;

(b) from about 7.2 wt % to about 24 wt % detersive surfactant;

(c) from about 2.4 wt % to about 8 wt % monomeric organic polycarboxylic acid; and (d) from about 0.3 wt % to about 2.4 wt % silica.

13. A process according to claim 1, wherein the spray-dried laundry detergent particle has a bulk density of less than about 550 g/l.

14. A process according to claim 1, wherein the spray-dried laundry detergent particle has a weight average particle size of from about 300 micrometers to about 600 micrometers.

* * * * *